US008739362B1

(12) United States Patent
Conder

(10) Patent No.: US 8,739,362 B1
(45) Date of Patent: Jun. 3, 2014

(54) GUTTER CLEANING ATTACHMENT FOR A LEAF BLOWER

(76) Inventor: Richard V. Conder, West Jordan, UT (US)

( * ) Notice: Subject to any disclaimer, the term of this patent is extended or adjusted under 35 U.S.C. 154(b) by 103 days.

(21) Appl. No.: 13/476,521

(22) Filed: May 21, 2012

(51) Int. Cl.
*E04D 13/076* (2006.01)
*A47L 5/00* (2006.01)
*A47L 9/08* (2006.01)
*A47L 7/00* (2006.01)

(52) U.S. Cl.
USPC ..... 15/406; 15/414; 15/415.1

(58) Field of Classification Search
CPC ..... A47L 5/14; A47L 9/08; E01H 1/08; E01H 1/0809; E01H 8/125; E04D 13/076; E04D 13/0765
USPC ..... 15/414, 405, 406, 410, 415.1; 285/7; 239/487–489
See application file for complete search history.

(56) References Cited

U.S. PATENT DOCUMENTS

| | | | | |
|---|---|---|---|---|
| 2,623,264 | A | 12/1952 | Brown | |
| 3,971,098 | A | 7/1976 | Davis | |
| 4,121,320 | A | 10/1978 | Feiner | |
| 4,304,498 | A | 12/1981 | George | |
| 4,402,106 | A | 9/1983 | Mattson | |
| 5,054,159 | A | 10/1991 | Richardson | |
| 5,386,942 | A | 2/1995 | Dietle | |
| 5,586,360 | A | 12/1996 | Diederiks, Jr. et al. | |
| 6,257,256 | B1 | 7/2001 | Fischer | |
| 6,519,809 | B2 | 2/2003 | Gutry | |
| 6,766,560 | B2 | 7/2004 | Murphy | |
| 6,843,516 | B2 * | 1/2005 | Bishop et al. | 285/420 |
| 7,549,191 | B2 | 6/2009 | Seasholtz et al. | |
| 2002/0157210 | A1 * | 10/2002 | Minor | 15/345 |
| 2004/0143931 | A1 | 7/2004 | Dennis | |
| 2006/0289036 | A1 * | 12/2006 | Hilton | 134/22.11 |
| 2011/0132405 | A1 * | 6/2011 | Lowenstein | 134/21 |
| 2011/0179598 | A1 * | 7/2011 | Esteban | 15/415.1 |

FOREIGN PATENT DOCUMENTS

WO WO2012007497 A1 * 1/2012 ..... B05B 1/34

* cited by examiner

*Primary Examiner* — Mark Spisich
*Assistant Examiner* — Andrew A Horton
(74) *Attorney, Agent, or Firm* — Robert C. Montgomery; Montgomery Patent & Design

(57) ABSTRACT

A gutter cleaning attachment for a leaf blower comprises an elongated angled pipe assembly adaptably attached to an existing leaf blower. An upper portion of the attachment is inserted into the gutter portion of a structure allowing propelled air from the leaf blower to remove debris such as leaves, twigs, silt, insect nests, seed pods, and other similar items. The safety of the user is improved by avoiding the use of ladders or climbing on roofs to perform gutter cleaning.

19 Claims, 5 Drawing Sheets

GUTTER CLEANING ATTACHMENT FOR A LEAF BLOWER

RELATED APPLICATIONS

There are currently no applications co-pending with the present application.

FIELD OF THE INVENTION

The presently disclosed subject matter is directed towards leaf blower attachments. More particularly, the present invention relates to a gutter cleaning attachment for leaf blowers.

BACKGROUND OF THE INVENTION

Most buildings and almost all houses include rain gutters. A rain gutter is a narrow trough which collects rain falling on the building and diverts it away from the building. This helps prevent water damage to the building while acting to protect the landscape and other features around the building.

While rain gutters are highly effective they have at least one (1) problem: at times they need cleaning. Many owners dread the thought and cost of the seasonal ritual of cleaning rain gutters. But a neglected gutter quickly becomes clogged with leaves and other debris, causing erosion, roof damage, and possibly building damage.

Most people perform gutter-cleaning by climbing ladders or walking along the edge of the roof itself. While this enables access to the gutter, cleaning them is time consuming and can lead to serious injury from slipping or falling from the roof or ladder. Using a garden hose to spray the gutters clean only increases this danger because it makes surfaces slippery.

Falling leaves not only clog gutters but cover yards, steps, walkways, and driveways. One (1) method of removing falling leaves is to use a leaf blower. Leaf blowers are rather versatile machines that can be used to remove fallen leaves and clean steps, walkways, and driveways. If you have a lot of leaves a leaf blower can save a lot of work.

Given that leaves will continue to fall and that cleaning gutters is a necessary task, it would be beneficial to have a machine that cleans gutters without having to get on a ladder or walk across a roof. Beneficially such a machine would be easy to use and low in cost.

SUMMARY OF THE INVENTION

The principles of the present invention provide for a gutter cleaner attachment for leaf blowers. The gutter cleaner attachment takes the form of a long, "J"-shaped plastic pipe having an overall diameter of approximately two inches (2 in.). The "J"-shaped section has a bend with a radius of about twelve inches (12 in.). The overall length of the "J"-shaped section itself is approximately six to eight feet (6-8 ft.), but additional six to eight foot (6-8 ft.) sections of pipe can be added to allow cleaning of gutters on the second floor of homes or buildings.

To use the gutter cleaner attachment a user attaches a long section of pipe, if needed to the output of a leaf blower. Then the "J"-shaped section is connected to the long section of pipe, if it is used or to the output of the leaf blower if the long section of pipe is not used. Then, the leaf blower is turned on and while running the "J"-shaped section is inserted into the gutter to remove objects such as leaves, twigs, silt, insect nests, seed pods, and other similar items. An output nozzle is provided with a swivel joint to allow adjustment to achieve optimum air pressure.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
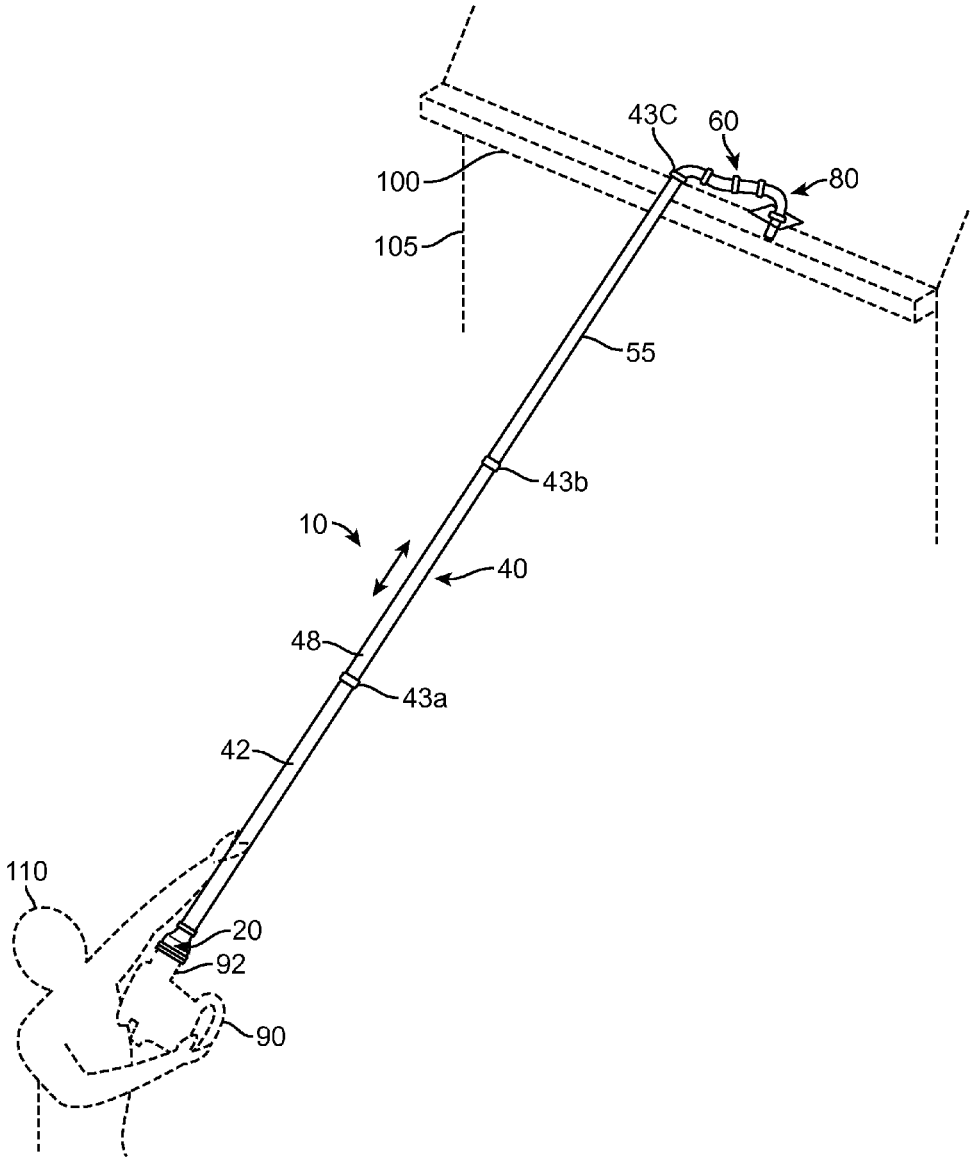
FIG. 1 is an environmental view of a gutter cleaning attachment 10 that is in accord with a preferred embodiment of the present invention.

10 gutter cleaning attachment
20 adapter assembly
22 adapter housing
24 first receiving aperture
26 second receiving aperture
28 gasket
30 clamp
40 extension assembly
42 first extension member
43*a* first threaded compression collar
43*b* second threaded compression collar
43*c* third threaded compression collar
43*d* fourth threaded compression collar
43*e* fifth threaded compression collar
43*f* sixth threaded compression collar
43*g* seventh threaded compression collar
43*h* eighth threaded compression collar
44*a* first male threaded region
44*b* second male threaded region
44*c* third male threaded region
44*d* fourth male threaded region
44*e* fifth male threaded region
44*f* sixth male threaded region
44*g* seventh male threaded region
44*h* eighth male threaded region
45*a* first stationary seal ring
45*b* second stationary seal ring
45*c* third integral seal ring
45*d* fourth integral seal ring
46*a* first sliding seal
46*b* second sliding seal
48 second extension member
55 third extension member
60 adjustable arm assembly
62 first ninety-degree (90°) elbow
64 forty-five degree (45°) elbow
66 first length-adjustable member
68 second length-adjustable member
70 second ninety-degree (90°) elbow
72 debris shield
74 shield aperture
80 nozzle assembly
81 nozzle body
82 spiral feature

84 female threaded receiver
88 air jet
90 leaf blower
92 leaf blower exhaust tube
100 gutter
105 structure
110 user

DETAILED DESCRIPTION OF THE PREFERRED EMBODIMENT

The best mode for carrying out the invention is presented in terms of its preferred embodiment, herein depicted within FIGS. 1 through 5, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention is a gutter cleaning attachment 10 for a leaf blower which provides a means to clean roof gutters 100. The gutter cleaning attachment 10 includes a long, "J"-shaped plastic pipe assembly adapted to attach to a leaf blower 90. With the leaf blower 90 providing air flow through the gutter cleaning attachment 10, an upper adjustable arm 60 of the "J"-shaped plastic pipe assembly is inserted into the gutter 100 of a structure 105. The air flow removes debris such as leaves, twigs, silt, insect nests, seed pods, and other similar items. Safety is thus improved due to the fact that a user 110 need not climb to the roof or climb a ladder to perform gutter cleaning. The use of the gutter cleaning attachment 10 enables quick, easy and effective cleaning of gutters 100.

FIG. 1 is an environmental view of the gutter cleaning attachment 10 according to a preferred embodiment of the invention. The gutter cleaning attachment 10 has a tubing assembly comprised of an adapter assembly 20, a linear extension assembly 40, an adjustable arm assembly 60, and a nozzle assembly 80. The assemblies 40, 60, 80 are envisioned to be made from a rugged plastic material such as polyvinylchloride (PVC) or the like. Those assemblies beneficially have inner diameters of approximately two (2) to three (3) inches which is wide enough to deliver a high volume air jet 88 (see FIG. 4) to clean the gutter 100.

The extension assembly 40 and the adjustable arm assembly 60 provide an adjustable means to position the nozzle assembly 80 within the gutter 100. The extension assembly 40 further provides a length adjustment comprised of a telescoping connection of a first extension member 42 and a second extension member 48. A first threaded compression collar 43*a* is used to secure the telescoping extension members 42, 48 together at a desired combined length. The extension assembly 40 is envisioned as being adjustable in length from approximately six (6) to sixteen (16) feet. However, one or more third extension members 55, each being approximately six (6) to eight (8) feet in length, may be added to the top end of the second extension member 48 as needed to allow cleaning of gutters 100 on two-story structures 105. The third extension member 55 is affixed via an additional second threaded compression collar 43*b*. The third extension member 55 is envisioned as being similar in construction and functionality as the previously described first 42 and second 48 extension members.

Figure 2:
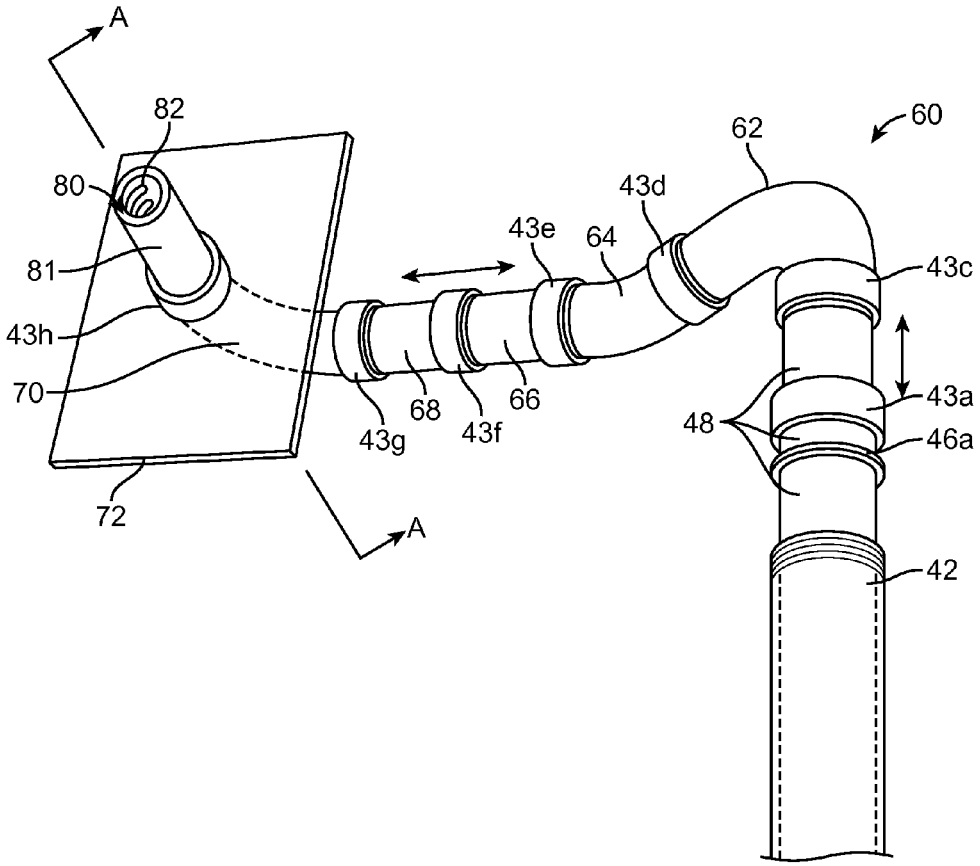
FIG. 2 is a close-up view of an adjustable arm assembly 60 and a nozzle assembly 80 of the gutter cleaning attachment 10 shown in FIG. 1.
Figure 3:
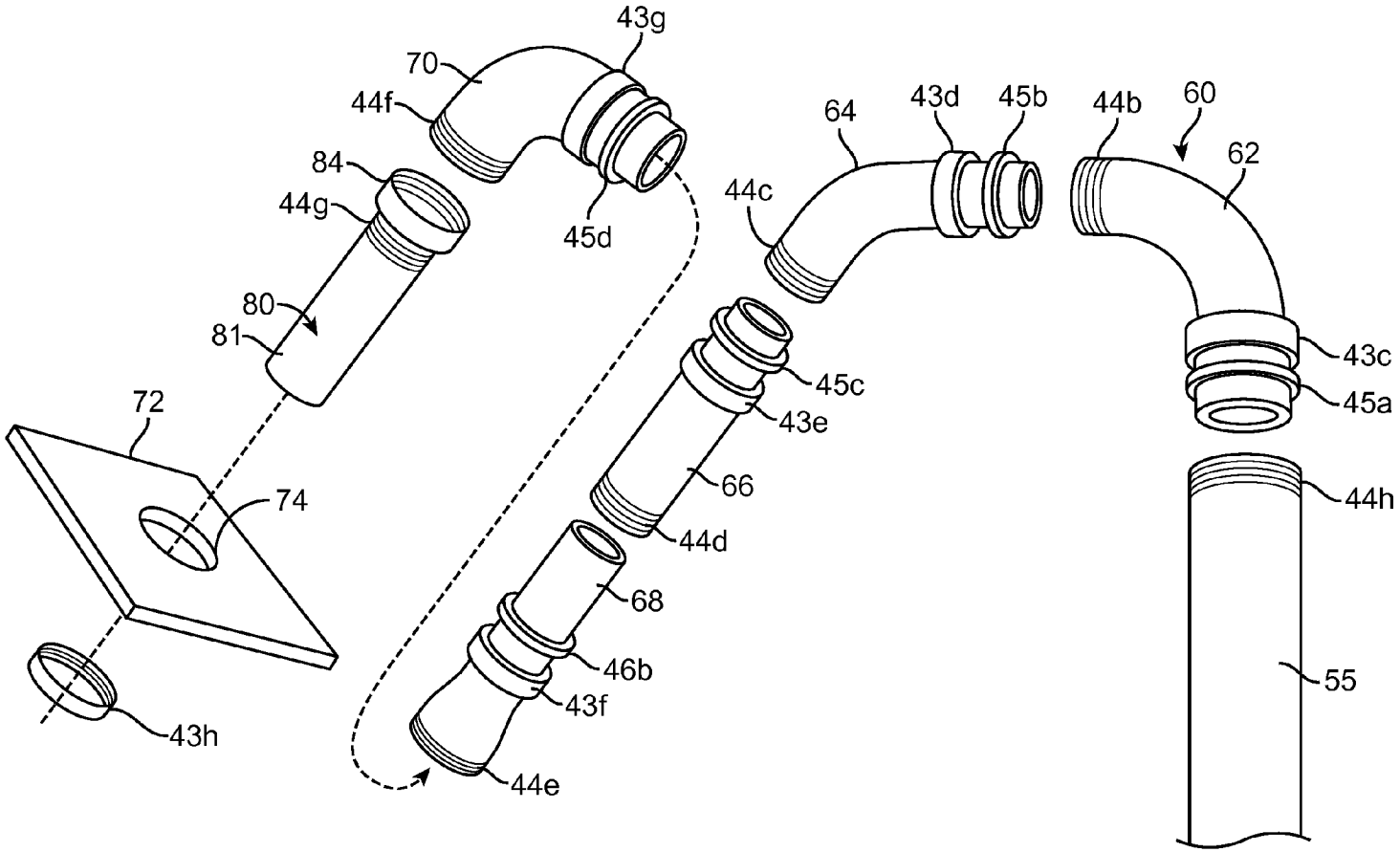
FIG. 3 is an exploded view of the adjustable arm 60 and nozzle 80 assemblies shown in FIG. 2.

Referring now to FIG. 1-FIG. 3, the third extension member 55 can provide a fixed-length or telescoping extension to the length of the extension assembly 40 via respective stationary 45 or sliding 46 seal rings which work in conjunction with threaded compression collars 43. The sliding seal rings 46 seal the telescoping connection between pairs of tubular members including the first 42 and second 48 extension members, and first 66 and second 68 length-adjustable members.

Figure 5:
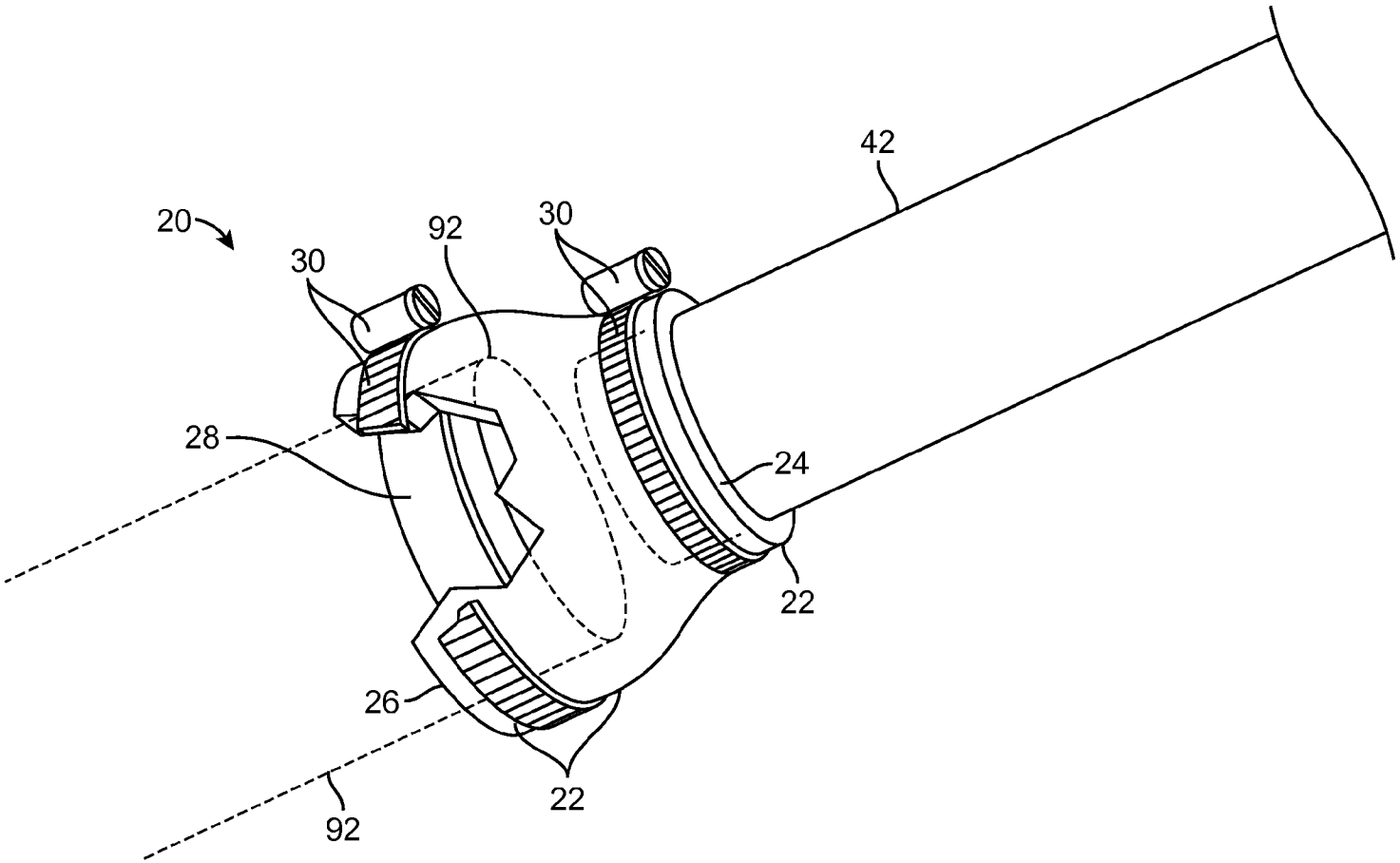

To use the gutter cleaning attachment 10, a user 110 attaches the linear extension assembly 40 to an output tube portion 92 of a common leaf blower 90 using the adapter assembly 20 (see FIG. 5). The adjustable arm assembly 60 is then adjusted via a plurality of elbows 62, 64, 70 and swivel joints to allow the air jet 88 to be applied to a specific target within the gutter 100 (see FIGS. 2 and 3).

Referring now to FIGS. 2 and 3 the adjustable arm assembly 60 provides a configurable tubular assembly that conforms to various gutter 100 designs and gutter arrangements as well as enabling a user 110 to selectively position his/her self on the ground while using the gutter cleaning attachment 10. The adjustable arm assembly 60 is depicted in FIG. 2 being affixed to length adjustable first extension member 42 and second extension member 48. The adjustable arm assembly 60 is depicted in FIG. 3 being affixed to an eighth male threaded region 44*h* of a third extension member 55 (see FIG. 1).

The adjustable arm assembly 60 comprises a plurality of interconnected fittings and joints including a first ninety-degree (90°) elbow 62, a forty-five (45°) degree elbow 64, a first length-adjustable member 66, a second length-adjustable member 68, and a second ninety-degree (90°) elbow 70. A particular arrangement of the members 62, 64, 66, 68, 70 is shown in a preferred embodiment for illustration sake; however, it is to be understood that the attachments of the members 62, 64, 66, 68, 70 allows easy disassembly and reassembly, thereby providing different assembled arrangements of the members 62, 64, 66, 68, 70 based upon various gutter 100 and structure 105 scenarios as well as a user's 110 preferred usage of the gutter cleaning attachment 10, and as such the illustrated view should not be interpreted as a limiting factor of the gutter cleaning attachment 10.

The proximal end of the first ninety-degree (90°) elbow 62 is connected to a first male threaded region 44*a* of the second extension member 48 via a third threaded compression collar 43*c* and an integrally-molded first stationary seal ring 45*a*. The distal end of the first ninety-degree (90°) elbow 62 comprises a second male threaded region 44*b* which in turn allows attachment to fourth threaded compression collar 43*d* and second stationary seal ring 45*b* of the proximal end of the forty-five degree (45°) elbow 64. A third male threaded region 44*c* along a distal end of the forty-five degree (45°) elbow 64 allows like connection to fifth threaded compression collar 43*e* and third stationary seal ring 45*c* at the proximal end of the first length-adjustable member 66. The first 66 and second 68 length-adjustable members provide a relative length adjustment means of approximately six (6) to twelve (12) inches, being telescoping and inserted in a similar fashion as the previously described first 42 and second 48 extension members (see FIG. 1).

Figure 4:
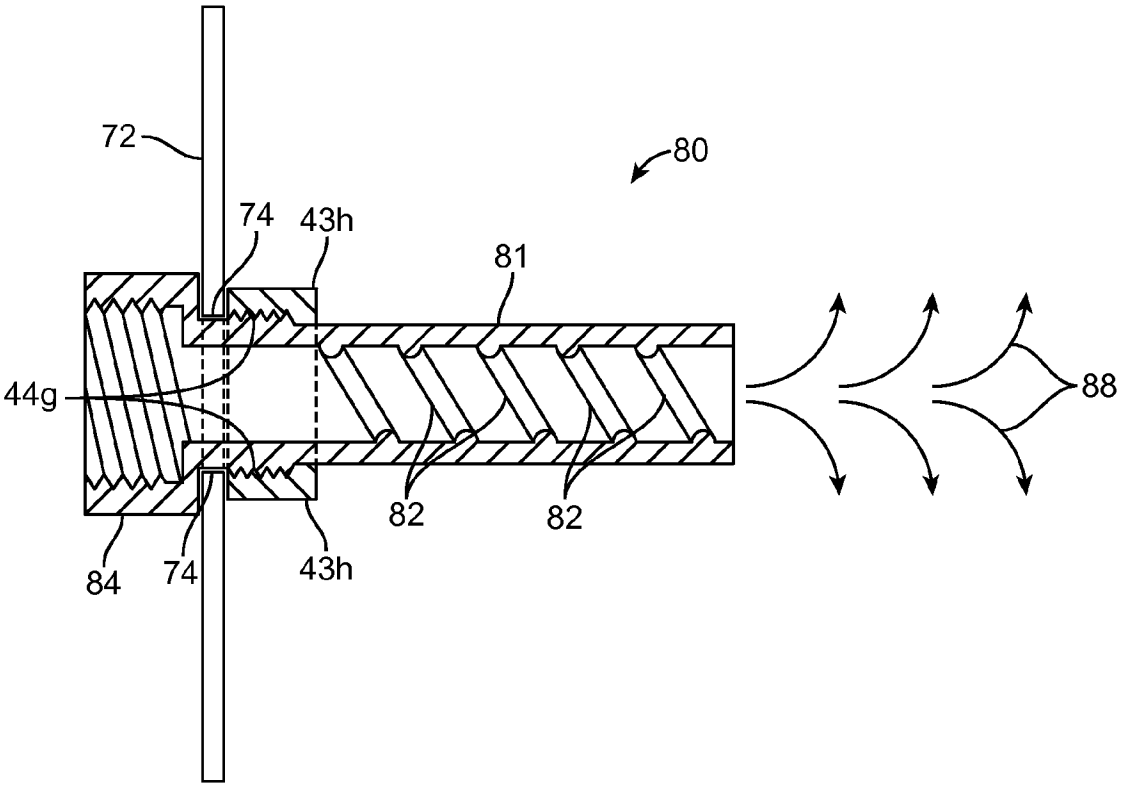
FIG. 4 is a section view of the nozzle assembly 80 taken along section line A-A of FIG. 2); and, FIG. 5 is a partial cut-away view of an adapter assembly portion 20 of the gutter cleaning attachment 10 shown in FIG. 1.

Still referring to FIG. 3 and FIG. 4, the first 66 and second 68 length-adjustable members may be adjusted to a desired respective length and secured in position via a joining fourth male threaded region portion 44*d* of the first length-adjustable member 66 and corresponding sixth threaded compression collar 43*f* and second sliding seal 46*b* portions of the second length-adjustable member 68. The distal end of the second length-adjustable member 68 comprises a fifth male threaded region 44*e* allowing attachment in like manner to a proximal end of the second ninety-degree (90°) elbow 70 via a seventh threaded compression collar 43*g* and fourth stationary seal ring 45*d* at the second ninety-degree (90°) elbow 70. A sixth male threaded region 44*f* of the second ninety-degree (90°) elbow 70, located at a distal end, provides threaded attachment to a female threaded receiver portion 84 of the nozzle assembly 80 (see FIG. 4).

The threaded compression collar portions 43*c*, 43*d*, 43*e*, 43*f*, 43*g* allow adjacent fitting members 62, 64, 66, 68, 70 to be rotated to a desired relative angle and secured by tightening onto respective male threaded regions 44*a*, 44*b*, 44*c*, 44*d*, 44*e*, thereby allowing a user 110 to configure the adjustable arm assembly 60 in a custom manner to conform to various gutter 100 applications.

FIG. 4 presents a section view of the nozzle assembly 80 taken along section line A-A of FIG. 2. The nozzle assembly 80 comprises a linear tubular body 81 that is approximately eight (8) inches long, a plurality of internal spiral features 82, a female threaded receiver 84, an eighth threaded compression collar 43*h*, and a debris shield 72. The nozzle assembly 80 provides a means to condition the air jet 88 via the spiral features 82 which accelerate and swirl the air jet 88 into the gutter 100, thereby providing improved cleaning of said gutter 100.

The spiral features 82 comprise a plurality of integrally-molded rib-like protrusions having semi-circular cross-sections that are arranged in a spiraling and parallel manner along an inner surface of the nozzle body 81. This increases the air turbulence of the air jet 88. The nozzle body 81 further provides an attachment to the removable debris shield 72. The debris shield 72 is a rectangular sheet of transparent plastic such as PLEXIGLAS®, LEXAN®, or the like, that is approximately one (1) foot square and one-quarter (¼) of an inch in thickness. The debris shield 72 directs air-borne debris away from the user 110 or away from portions of the structure 105. The debris shield 72 further has a centrally-located shield aperture 74 sized to be slid into the nozzle body 81 and subsequently become entrapped between a shoulder feature of the female threaded receiver 84 and the eighth threaded compression collar portion 43*h* once it is affixed to an integral seventh male threaded region portion 44*g* of the nozzle body 81.

FIG. 5 presents a partial cut-away view of an adapter assembly 20 of the gutter cleaning attachment 10. The adapter assembly 20 comprises a tubular "bell-shaped" adapter housing 22 having different sized open ends. One (1) end forms a first receiving aperture 24 while the other end forms a second receiving aperture 26. The first 24 and second 26 receiving apertures are sized to fit upon the first extension member 42 and the leaf blower exhaust tube 92, respectively. The adapter assembly 20 is envisioned as be made from a semi-rigid plastic or rubber material. The first 24 and second 26 receiving apertures are respectively secured to the first extension member 42 and to the leaf blower exhaust tube 92 using a pair of adjustable common hose clamps 30. The adapter assembly 20 further comprises a circular rubber gasket 28 with a rectangular cross-section which is positioned between the second receiving aperture 26 and the leaf blower exhaust tube 92 to reduce or eliminate air leakage due to slight differences in diameter or shape, or to seal any surface inconsistencies of the leaf blower exhaust tube 92.

It is envisioned that other styles and configurations of the present invention can be easily incorporated into the teachings of the present invention, and only one particular configuration is shown and described for purposes of clarity and disclosure and not by way of limitation of scope. The preferred embodiment of the present invention can be utilized by the common user in a simple and effortless manner with little or no training. After initial purchase or acquisition of the gutter cleaning attachment 10, it would be installed and utilized as indicated in FIG. 1. The method of installing and utilizing the gutter cleaning attachment 10 may be achieved by performing the following steps: procuring the gutter cleaning attachment 10; assembling the nozzle assembly 80 to the adjustable arm assembly 60 by threading the respective female threaded receiver 84 and sixth male threaded region 44*f* portions; adjusting the members of the adjustable arm assembly 60 in such a manner as to direct the air jet 88 down into the gutter 100 while conforming to a particular gutter 100 profile on the structure 105; assembling the first 42 and second 48 extension members of the extension assembly 40 using the first threaded compression collar 43*a*; assembling one (1) or more third extension members 55 to an upper end of the extension assembly 40, as needed, to reach an elevated gutter 100; securing the first receiving aperture 24 portion of the adapter assembly 20 onto a lower end portion of the extension assembly 40 using a clamp 30; assembling the second receiving aperture portion 26 of the adapter assembly 20 to the leaf blower exhaust tube 92 using a clamp 30; adjusting a length of the extension assembly 40 as needed by telescoping and adjusting the first 42 and second 48 extension members; securing an overall length of said first 42 and second 48 extension members by tightening the first threaded compression collar 43*a*; grasping and lifting the leaf blower 90 and extension assembly 40 with both hands; positioning the nozzle assembly 80 within the gutter 100; starting the leaf blower 90 to initiate the air jet 88 from the nozzle assembly 80 into the gutter 100; motioning said nozzle assembly 80 along the gutter 100 to displace debris contained within; and, benefiting from utilizing the apparatus 10 to effectively remove debris from within a gutter 100 without experiencing the hazards associated with using ladders or climbing upon a roof to perform such a task.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A gutter cleaner attachment, comprising:

a rigid extension member having a coupling at a distal end;

an adapter assembly having a tubular "bell-shaped" adapter housing with a proximal end dimensioned to receive a leaf blower exhaust tube and a distal end dimensioned to receive said extension member;

a rigid, telescoping length adjustable "J"-shaped plastic pipe assembly having a distal end with an upper adjustable arm and a proximal end mating with said distal end of said extension member; and, a nozzle assembly attached to said upper adjustable arm;

wherein air flow from the leaf blower passing through said nozzle assembly can remove debris from a gutter.

2. The gutter cleaner attachment according to claim 1, further comprising clamps for attaching said adapter assembly to said leaf blower exhaust tube and to said extension member.

3. The gutter cleaner attachment according to claim 2, further including a gasket between said adapter assembly and said leaf blower.

4. The gutter cleaner attachment according to claim 1, wherein said adapter assembly is comprised of a semi-rigid material.

5. The gutter cleaner attachment according to claim 1, wherein said "J-shaped" plastic pipe assembly and said extension member are connected by a compression collar.

6. The gutter cleaner attachment according to claim 1, wherein said extension member is comprised of a plurality of members.

7. The gutter cleaner attachment according to claim 1, wherein said adjustable arm includes a plurality of interconnected fittings and joints.

8. The gutter cleaner attachment according to claim 7, wherein said plurality of interconnected fittings and joints are threaded together using compression fittings and seals.

9. The gutter cleaner attachment according to claim 1, wherein said nozzle assembly includes a debris shield.

10. The gutter cleaner attachment according to claim 9, wherein said nozzle assembly further includes spiral features for increasing air velocity.

11. A gutter cleaner attachment, comprising:

a rigid, telescoping length adjustable "J"-shaped plastic pipe assembly having a distal end with an upper adjustable arm and a proximal end;

an adapter assembly having a tubular "bell-shaped" adapter housing with a proximal end dimensioned to receive a leaf blower exhaust tube and a distal end dimensioned to receive said proximal end of said "J"-shaped plastic pipe assembly; and, a nozzle assembly attached to said upper adjustable arm;

wherein air flow from the leaf blower passing through said nozzle assembly can remove debris from a gutter.

12. The gutter cleaner attachment according to claim 11, further comprising clamps for attaching said adapter assembly to said leaf blower exhaust tube and to said "J"-shaped plastic pipe assembly.

13. The gutter cleaner attachment according to claim 12, further including a gasket between said adapter assembly and said leaf blower.

14. The gutter cleaner attachment according to claim 11, wherein said adapter assembly is comprised of a semi-rigid material.

15. The gutter cleaner attachment according to claim 11, wherein "J"-shaped plastic pipe assembly is comprised of a plurality of members.

16. The gutter cleaner attachment according to claim 11, wherein said adjustable arm includes a plurality of interconnected fittings and joints.

17. The gutter cleaner attachment according to claim 16, wherein said plurality of interconnected fittings and joints are threaded together using compression fittings and seals.

18. The gutter cleaner attachment according to claim 11, wherein said nozzle assembly includes a debris shield.

19. The gutter cleaner attachment according to claim 18, wherein said nozzle assembly further includes spiral features for increasing air velocity.

* * * * *